US006141927A

United States Patent [19]

Usui

[11] Patent Number: 6,141,927

[45] Date of Patent: Nov. 7, 2000

[54] KNOCKDOWN GARDEN DECK

[76] Inventor: Hiroyuki Usui, 16-9, Yachiyo 2-chome, Utsunomiya-shi, Tochigi-ken, Japan

[21] Appl. No.: 09/206,220

[22] Filed: Dec. 7, 1998

[30] Foreign Application Priority Data

Dec. 8, 1997 [JP] Japan ..... 9-354161
Jun. 24, 1998 [JP] Japan ..... 10-193796

[51] Int. Cl.[7] ..... E04B 5/14; E04B 1/19; E04B 1/26; E04B 1/38

[52] U.S. Cl. ..... 52/263; 52/299; 52/653.1; 403/170

[58] Field of Search ..... 52/263, 299, 653.1, 52/656.1, 656.9; 403/169, 170, 217; 108/153.1, 180; 446/108, 122, 123, 124, 126, 120

[56] References Cited

U.S. PATENT DOCUMENTS 198,926 1/1878 Doyd .
2,712,199 7/1955 Latimer .
3,004,364 10/1961 Benkelman .
4,084,344 4/1978 Asano .
4,485,598 12/1984 Guardiani ..... 52/79.1
4,691,484 9/1987 Wilson ..... 52/79.6
4,823,529 4/1989 Canfield et al. ..... 52/263
5,313,756 5/1994 Ways et al. ..... 52/263
5,361,554 11/1994 Bryan ..... 52/480
5,392,575 2/1995 Hoffman et al. ..... 52/299
5,469,678 11/1995 Zamerovsky ..... 52/263
5,771,646 6/1998 DeSouza ..... 52/263
5,813,737 9/1998 Stone .
6,061,991 5/2000 Dahl ..... 52/720.2

*Primary Examiner*—Robert Canfield
*Attorney, Agent, or Firm*—Hoffman, Wasson & Gitler

[57] ABSTRACT

A knockdown garden deck, assembly and manufacture of which are simplified with a small number of components, and a fence and the like of which are built firmly, is provided.

A frame member (10) and reinforcing frame members (21, 22, 23) form a deck floor. The frame member is obtained by combining longitudinal deck frames (11) and lateral deck frames (12) into a quadrilateral shape to place a decking (13) in it. The reinforcing frame members are framed to form mortices (h) at four corners of the frame member. Fence posts formed with elongated tenons projecting to extend through the mortices (h) are provided to vertically stand on the upper side of the deck floor. A fence body is fitted between the fence posts by clamping. Clustered piers (41) formed with tenon recesses at upper ends thereof are provided on the lower side of the deck floor. The tenon recesses fit on the tenons of the fence posts that extend through the mortices.

15 Claims, 11 Drawing Sheets

KNOCKDOWN GARDEN DECK

BACKGROUND OF THE INVENTION

1. Field of the Invention

The present invention relates to a garden deck built on the garden of a house or cottage.

2. Description of the Related Art

Concerning a garden deck of this type, a method of manufacturing as units deck boards, frames, fences, and the like that form the components of the garden deck and building the garden deck by assembling the component units at the construction site is known.

In the conventional known method, since the number of components, e.g., clusteredpiers, deckboards, cornerposts, studs, end posts, and top beams, is large, assembly becomes complicated, and the respective types of components must be made in the manufacture, leading to an increase in cost and producing a waste.

Concerning the structure of the garden deck, the fence posts and the clustered piers are not directly connected, but merely the fence posts are fixed to the deck floor or are directly connected to the floor post footing without using clustered piers. Therefore, rigid support cannot be obtained, and the fence tends to sway undesirably.

SUMMARY OF THE INVENTION

The present invention has been made in view of the above situation, and has as its object to develop a knockdown garden deck in which the number of components is reduced as much as possible to simplify assembly and manufacture and the fence and the like are firmly built.

It is another object of the present invention to provide a garden deck having a size that matches the user's request by only changing the number of combinations of predetermined types of components.

It is still another object of the present invention to provide a garden deck for which time and cost required for assembly can be reduced, i.e., to provide a garden deck having a desired size which can be completed by only assembling predetermined types of components.

It is still another object of the present invention to enable installation of a garden deck having a desired size by manufacturing desired types of components on the mass production line at a factory or the like and combining a required number of components at the construction site, so that a garden deck is provided for which time and cost required for assembly are reduced.

In order to achieve the above objects, according to the present invention, there is provided a knockdown garden deck wherein, for example, a frame member and reinforcing frame members form a deck floor, the frame member being obtained by combining longitudinal deck frames and lateral deck frames into a quadrilateral shape to place a decking therein, and the reinforcing frame members being framed to form mortices at four corners of the frame member, fence posts formed with elongated tenons to extend through the mortices are provided to vertically stand on an upper side of the deck floor and a fence body is fitted between the fence posts by clamping, and clustered piers formed with tenon recesses at upper ends thereof are provided on a lower side of the deck floor, the tenon recesses serving to fit on the tenons of the fence posts that extend through the mortices.

Combinations of frame member units and reinforcing frame member units can realize a garden deck that matches the main house and garden. The frame members, reinforcing frame members, clustered piers, fence posts, deckings, and fence bodies enable all assembly. As a result, the assembly operation becomes simple and the manufacturing cost becomes low.

The mortices are formed by the frame members and reinforcing frame members. When the tenons of the fence posts are fitted in the mortices and the lower portions of the fence posts are fixed in the tenon recesses of the clustered piers, the fence is firmly fixed from the three-dimensional direction through fitting with tenons and support from below. Therefore, the fence will not sway. If elongated bolt holes where the clustered piers and bolts can slide vertically are formed in the tenons of the fence posts that are to be fitted in the tenon recesses of the clustered piers, when some difference occurs in the height of the floor post footing due to the height difference of the ground and the like, this height difference can be absorbed by sliding the clustered pier along the elongated bolt holes.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

Figure 1A:
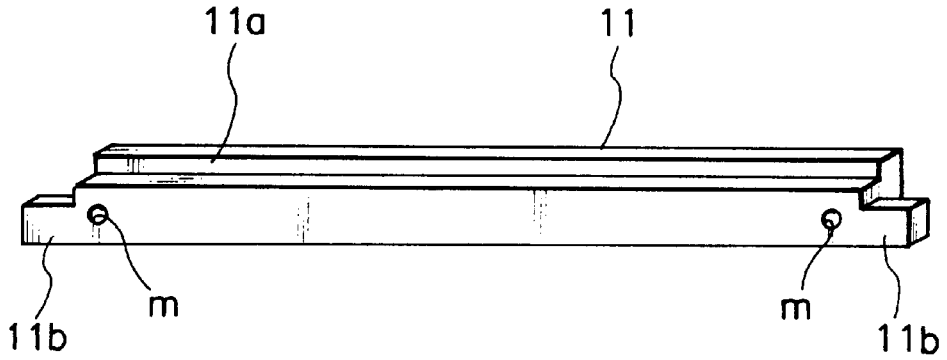
FIG. 1A is a perspective view of a longitudinal deck frame member according to an embodiment of the present invention.

One embodiment of the present invention is constituted by frame members 10 each forming one subunit partly constituting a deck unit, reinforcing frame members 20 for reinforcing the frame members 10, fence members 30 for forming a fence, and clustered pier members 40 for forming the footing.

In the frame member 10, reference numeral 11 denotes a longitudinal deck frame; 11*a*, a reception groove; 11*b*, a projection; 12, a lateral deck frame; and 13, a decking. In the reinforcing frame member 20, reference numerals 21, 22, and 23 denote reinforcing deck frames, respectively.

In the fence member 30, reference numeral 31 denotes a fence post; and 32, a fence body. In the clustered pier member 40, reference numerals 41 and 42 respectively denote clustered piers; and 41*a* and 42*b*, tenon recesses.

Figure 6:
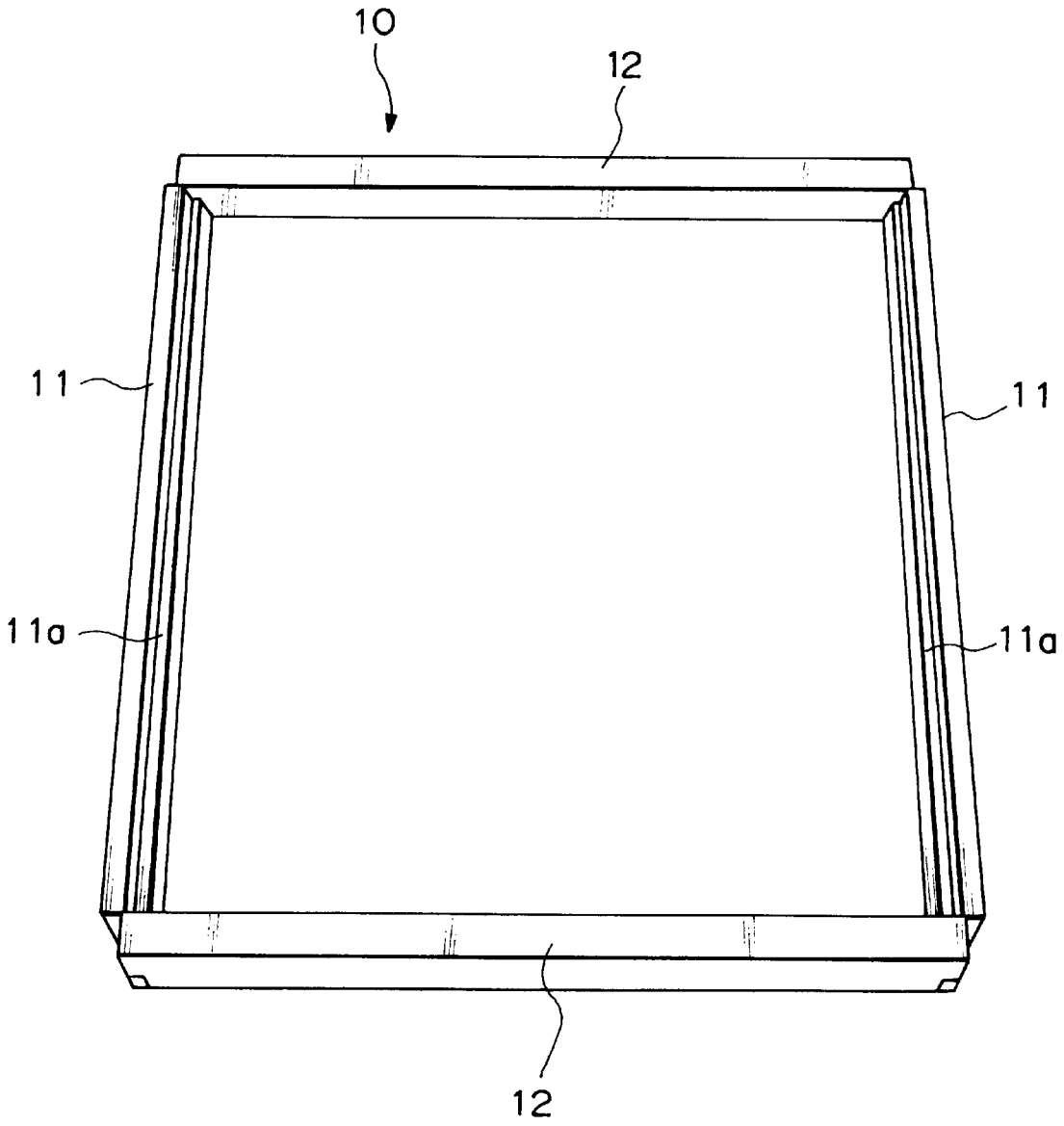
FIG. 6 is a perspective view of a state wherein a frame members of this embodiment are formed into a quadrilateral shape.

Concerning the frame member 10, as shown in FIG. 6, the longitudinal deck frames 11 and lateral deck frames 12 are combined longitudinally and laterally to form the quadrilateral frame member 10, and the decking 13 to be described later is placed in the frame members 10 by fitting.

For this purpose, first, as shown in FIG. 1A, the reception groove 11*a* is formed in each longitudinal deck frame 11 along its upper corner in order to fit with the decking 13 (to be described later). The projections 11*b* to butt with the lateral deck frames 12 in the half-lap manner are formed at the ends of the longitudinal deck frame 11.

Figure 1B:
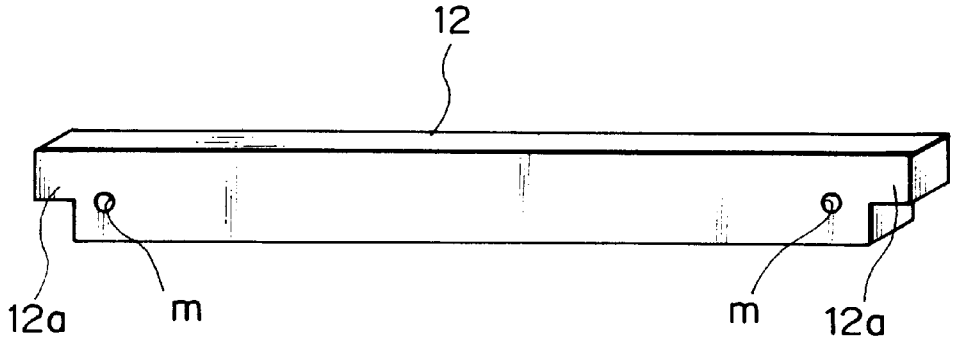
FIG. 1B is a perspective view of a lateral deck frame member of this embodiment.

As shown in FIG. 1B, recesses 12*a* to butt with the longitudinal deck frames 11 in the half-lap manner are formed in the lateral deck frame 12. A mortice h must be formed between the longitudinal deck frame 11 and the reinforcing frame member 20 (to be described later). For this purpose, the lateral deck frame 12 is not formed to coincide with the ends of the longitudinal deck frame 11, but is formed shorter than the longitudinal deck frame 11 by the length of the mortice (see FIG. 7).

The depth of the reception groove 11*a* of the longitudinal deck frame 11 is preferably substantially equal to the thickness of the decking 13. The width of the reception groove 11*a* is preferably of such a size that the reception groove 11*a* can reliably engage with the end of the decking 13, and is preferably equal to or smaller than half the thickness of the longitudinal deck frame 11. The projection 11*b* corresponds to the shape of the recess 12*a* of the lateral deck frame 12. The width of the projection 11*b* is formed to be half the width of the tenon, so that it can fit with a tenon 31*a* of the fence post 31 or tenon 42*a* of the clustered pier 42, together with the recess of the reinforcing frame member 20, when the reinforcing frame member 20 is mounted on the outer side of the projection 11*b*.

As shown in FIG. 6, the longitudinal deck frames 11 and lateral deck frames 12 are combined vertically and laterally to form a quadrilateral frame. This quadrilateral frame is a unit constituting the garden deck of this embodiment, and has, e.g., a quadrilateral shape with a side of 900 mm. The size of the frame is not limited to this example.

Figure 7:
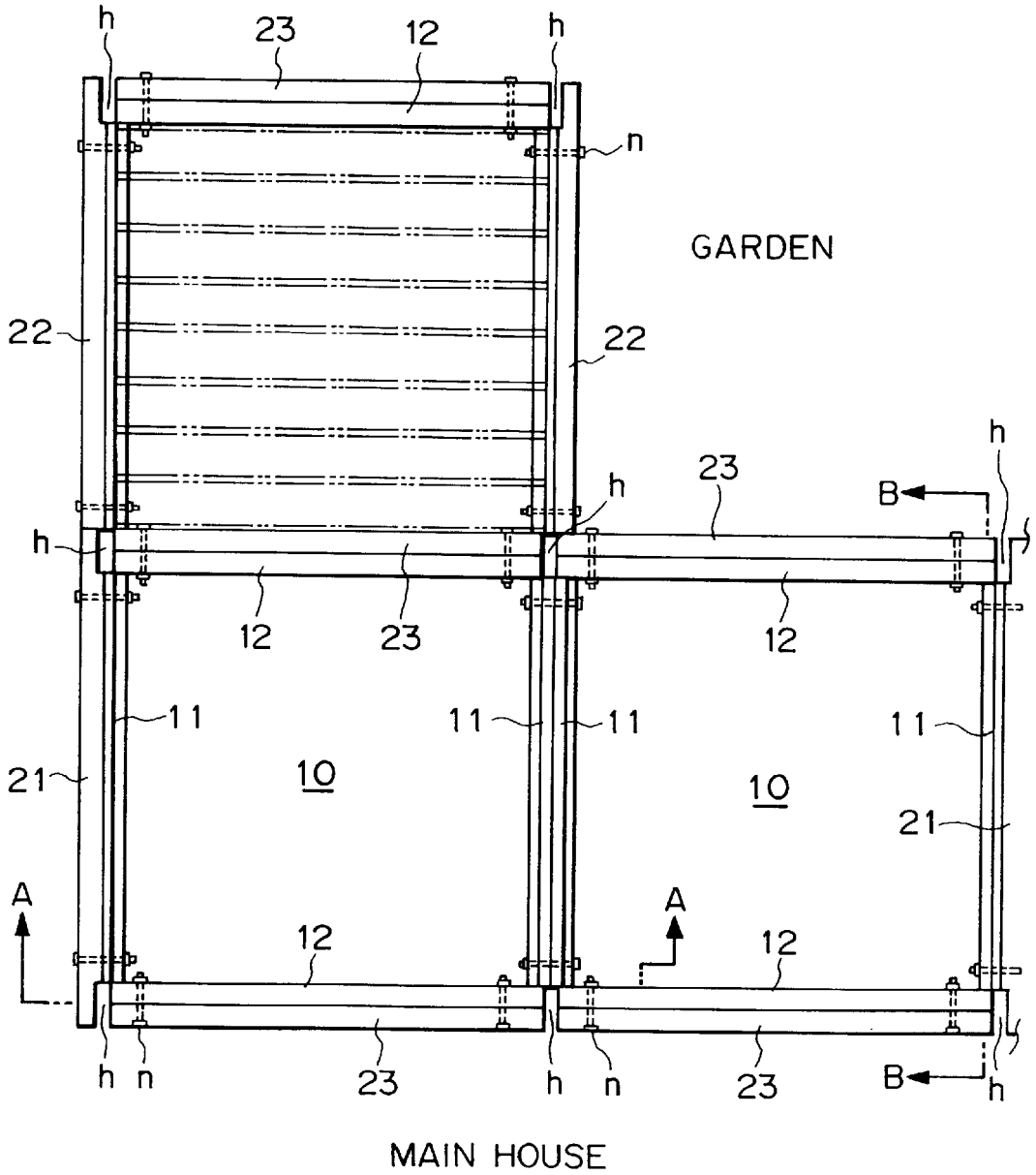
FIG. 7 is a plan view of a state wherein the frame members and reinforcing frame members of this embodiment are combined.

Concerning the number of quadrilateral frames and how to connect them, for example, two frames are continuously connected on the main house side and one frame is connected to project to the garden side, resulting in a total of three frames, as shown in FIG. 7. However, the number of quadrilateral frames and how to connect them are not limited to this example, and can be suited to various demands by changing them in accordance with the shape of the main house, the size of the garden, and the like.

The reinforcing frame members 20 are disposed on the outermost side of the quadrilateral frame member 10 which is combined as shown in FIG. 7. The reinforcing frame members 20 compensate for the physical strength and the like of the frame member 10 and form the mortices h at the four corners of the frame member 10, where the fence posts 31 and clustered piers 42 are to be set to extend vertically.

Three types of reinforcing frame members 20 are available, i.e., the reinforcing deck frames 21, 22, and 23, to match the frame member 10 and the manner it is combined.

Figure 2A:
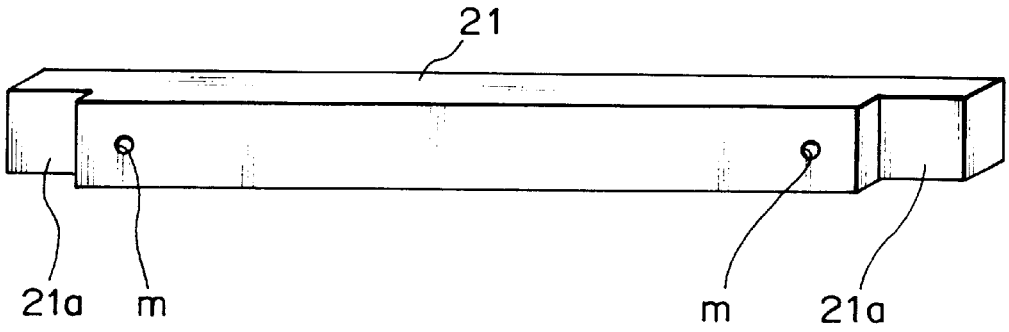
FIG. 2A is a perspective view of a reinforcing frame member of this embodiment which is formed with groove recesses at its two ends.
Figure 8:
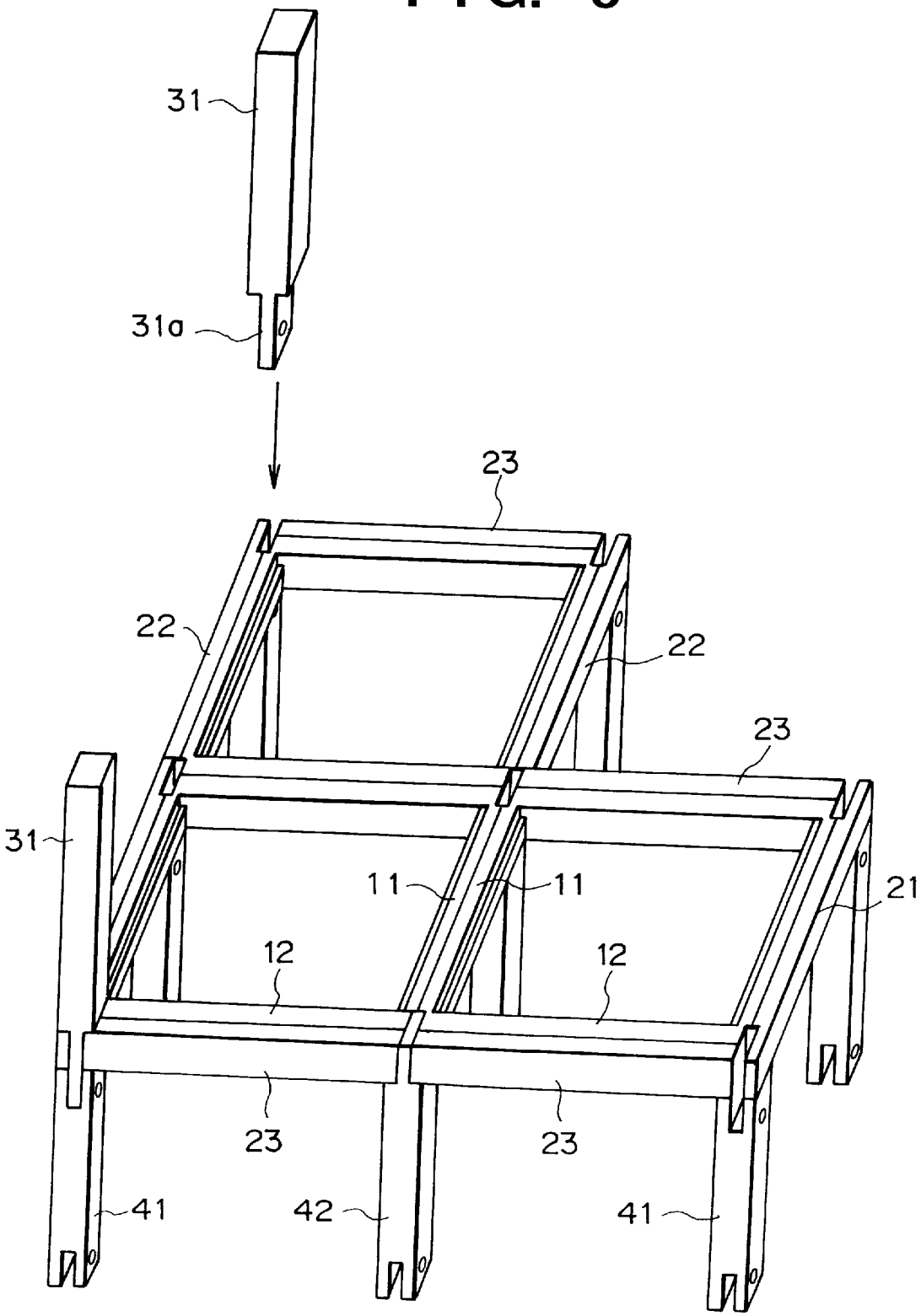
FIG. 8 is a perspective view of a state wherein fence posts are to be mounted on the frame members and reinforcing frame members of this embodiment.

The reinforcing deck frame 21 is formed with groove recesses 21*a* on its front and rear ends, as shown in FIGS. 2A, 7, and 8. Because of the groove recesses 21*a*, the opposing lateral deck frame 12, the opposing longitudinal deck frames 11, and the reinforcing deck frame 23 form mortices h. The reinforcing deck frame 21 is disposed on the outermost side in the longitudinal direction of the frame member 10 on the main house side.

Figure 2B:
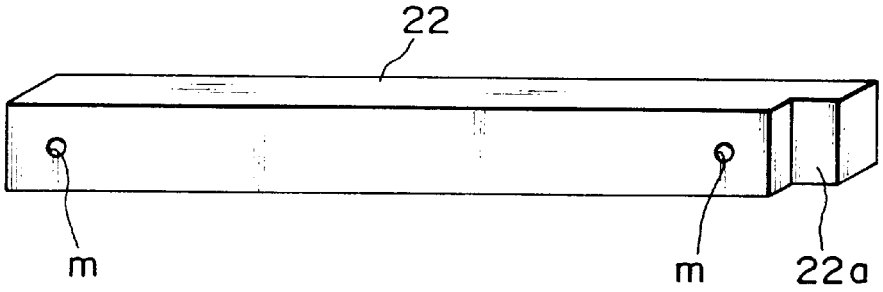
FIG. 2B is a perspective view of a reinforcing frame member of this embodiment which is formed with a groove recess at its one end.

Similarly, the reinforcing deck frame 22 is formed with a groove recess 22*a* on its one (front) distal end, as shown in FIGS. 2B, 7, and 8. Because of the respective groove recesses 22*a*, the opposing lateral deck frames 12, the reinforcing deck frames 23, and the longitudinal deck frames 11 form mortices h. No groove is formed at the other end of the reinforcing deck frame 22. The reinforcing deck frame 22 is disposed on the outermost side in the longitudinal direction of the frame member 10 on the main house side.

Figure 2C:
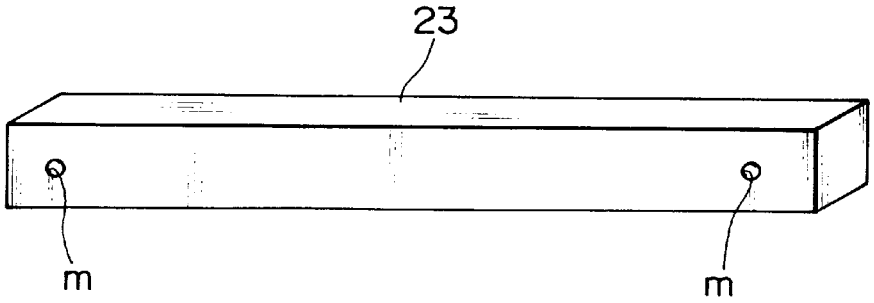
FIG. 2C is a perspective view of a reinforcing frame member of this embodiment which is not formed with a groove recess.

The reinforcing deck frame 23 has the same size as that of the lateral deck frame 12, so that when it is laid on the lateral deck frame 12, it forms mortices h together with the reinforcing deck frame 21 and longitudinal deck frame 11 that oppose each other, as shown in FIGS. 2C, 7, and 8. The reinforcing deck frame 23 corresponds to the lateral direction of the main house. Another reinforcing deck frame 23 is disposed in the lateral direction on the garden side as well.

The frame members 10 and reinforcing frame members 20 are connected by combining the frame members with each other and with the reinforcing frame member, as shown in FIG. 7. This connection is achieved by forming bolt holes m at the appropriate portions (e.g., near the two ends) of the frames, and inserting and screwing bolt-nuts n in the bolt holes m.

The reinforcing frame members 20 compensate for the physical strength of the frame members serving as the deck beams and form the mortices h at the four corners of the quadrilateral frame member 10, formed by the longitudinal deck frames 11 and lateral deck frames 12, in accordance with the shape of the frame member 10.

Figure 3:
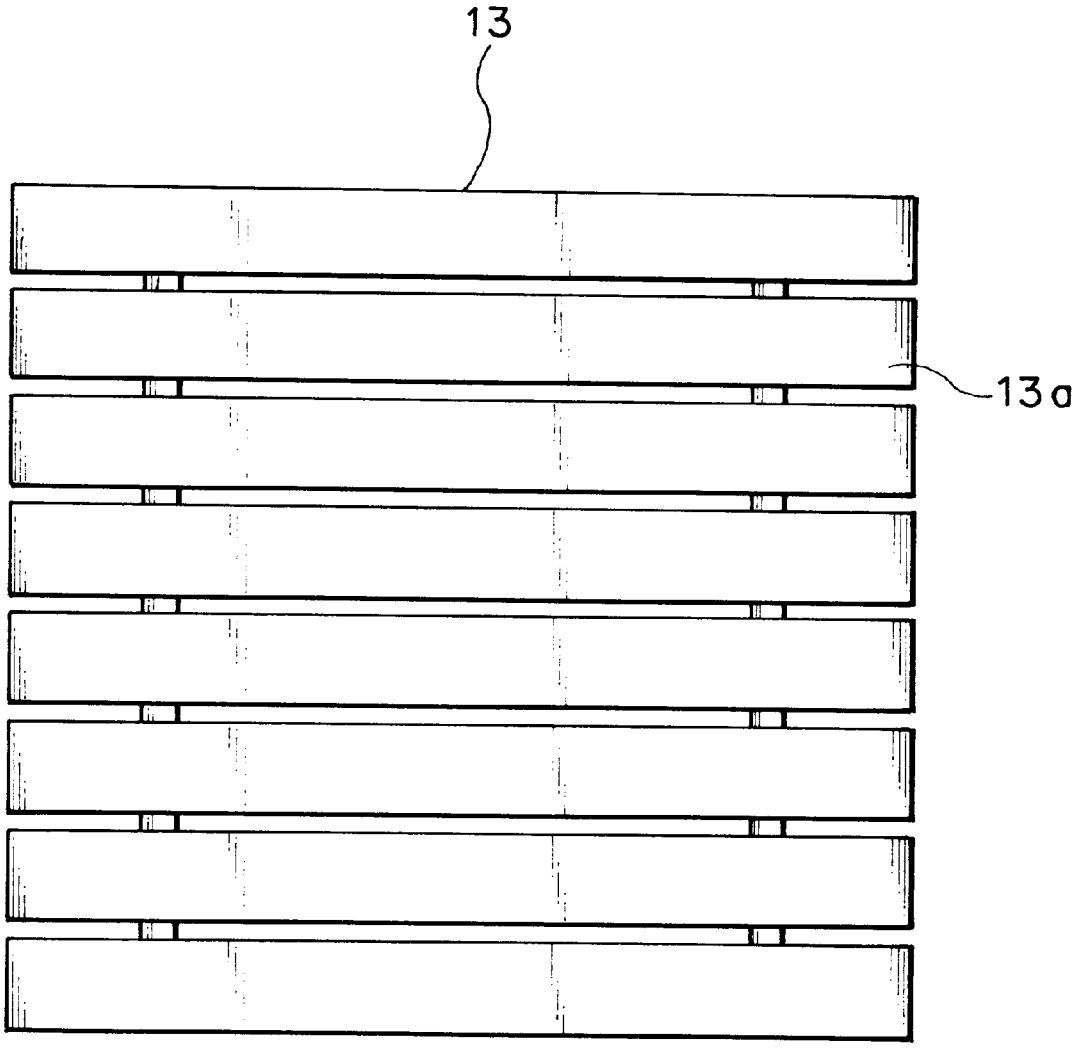
FIG. 3 is a plan view of a decking of this embodiment.

The decking 13 shown in FIG. 3 is fitted in the frame member 10. To form the decking 13, a duckboard-like boards 13*a* are formed and fitted in the reception grooves 11*a* formed in the longitudinal deck frames 11. The shape of the boards 13*a* is not limited to the duckboard, and can be, e.g., a square board partly formed with holes.

The deck floor is formed by fitting the decking 13 in the frame members 10. The fence members 30 forming a fence are disposed on the deck floor.

The fence member 30 is constituted by the fence posts 31 and fence body 32. Each fence post 31 has the elongated tenon 31*a* projecting from its lower end, and a post 31*b* at its upper portion to have a length appropriate for the fence, as shown in FIGS. 4A, 8, 9, and 10. The tenon 31*a* extends through the mortice h formed by the frame member 10 and reinforcing frame member 20 and is fitted in the tenon recess 41*a* formed in the clustered pier 41 (to be described later).

Figure 4B:
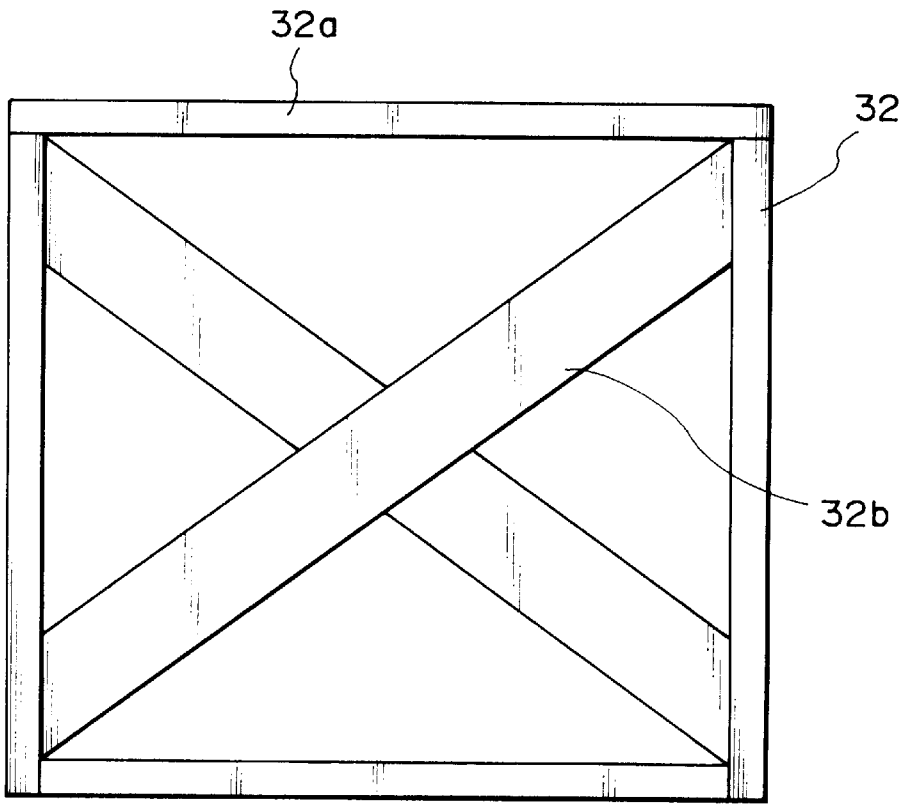
FIG. 4B is a front view of a fence body of this embodiment.
Figure 4A:
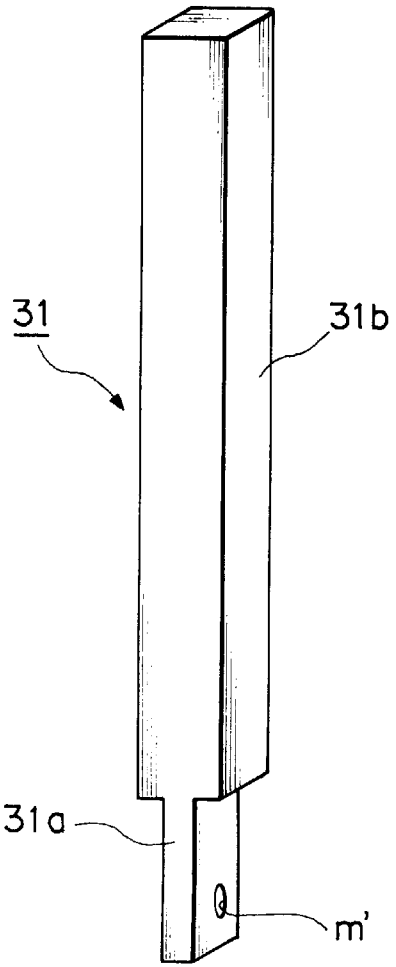
FIG. 4A is a perspective view of a fence post of this embodiment.

The fence body 32 is formed by fixing boards 32*b* on a quadrilateral frame 32*a* to cross each other, as shown in FIG. 4B. However, the shape of the fence body 32 is not limited to this but can be of any type as far as it serves as a fence. For example, rails may be fixed on the frame 32*a* at a predetermined interval, a grid may be fixed on the frame 32*a*, or balusters may be fixed on the frame 32*a* at a predetermined interval. The width of the fence body 32 is substantially equal to the distance between the two disposed fence posts 31.

The clustered pier members 40 for maintaining the deck floor at a predetermined height from the footing and supporting it are built and fixed under the deck floor shown in FIG. 7.

Figure 5B:
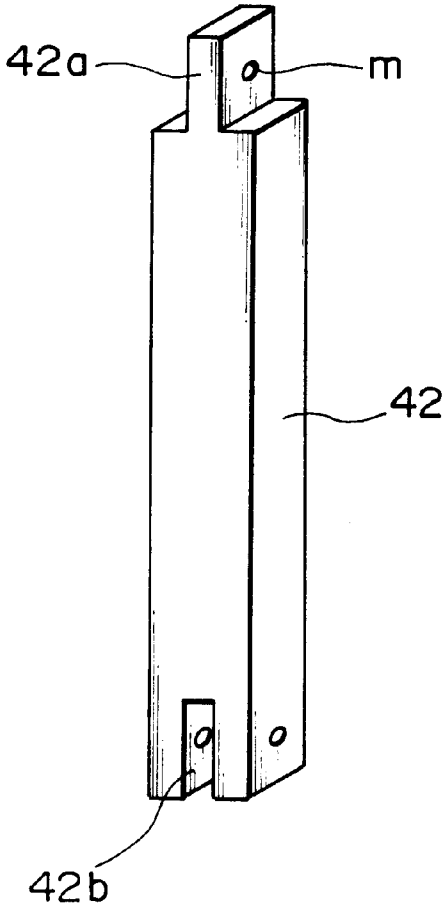
FIG. 5B is a perspective view of a clustered pier member of this embodiment formed with a tenon at its upper end and a tenon recess at its lower portion.
Figure 5A:
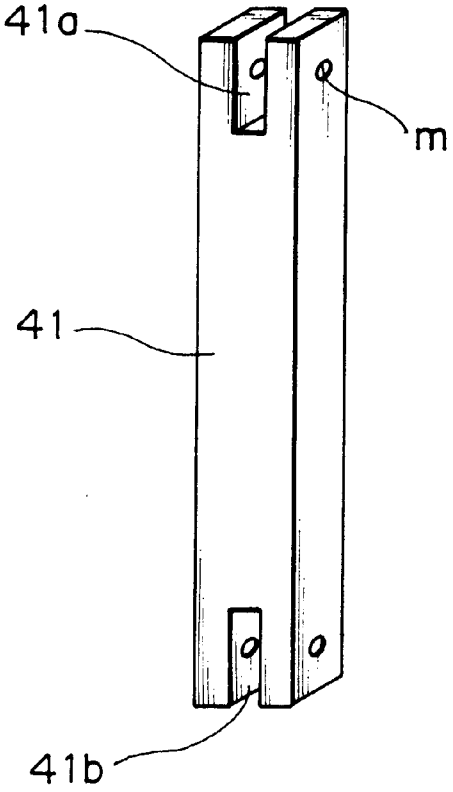
FIG. 5A is a perspective view of a clustered pier member of this embodiment formed with tenon recesses at its upper and lower portions, respectively.

Two types of clustered pier members 40 are available. One type is the clustered pier 41 formed with the tenon recess 41*a* at its upper portion and a tenon recess 41*b* at its lower portion, as shown in FIG. 5A. The tenon recess 41*a* is fitted with the tenon, extending from the clustered pier 41, in the tongue-and-groove joint manner. The other type is the clustered pier 42 formed with the tenon 42*a* at its upper portion to fill the mortice h, and the tenon recess 42*b* at its lower portion, as shown in FIG. 5B.

The clustered pier 42 can be used to fit with the clustered pier 41 or with another clustered pier 42 so as to increase the height of the deck, thereby adjusting the deck height.

Figure 11:
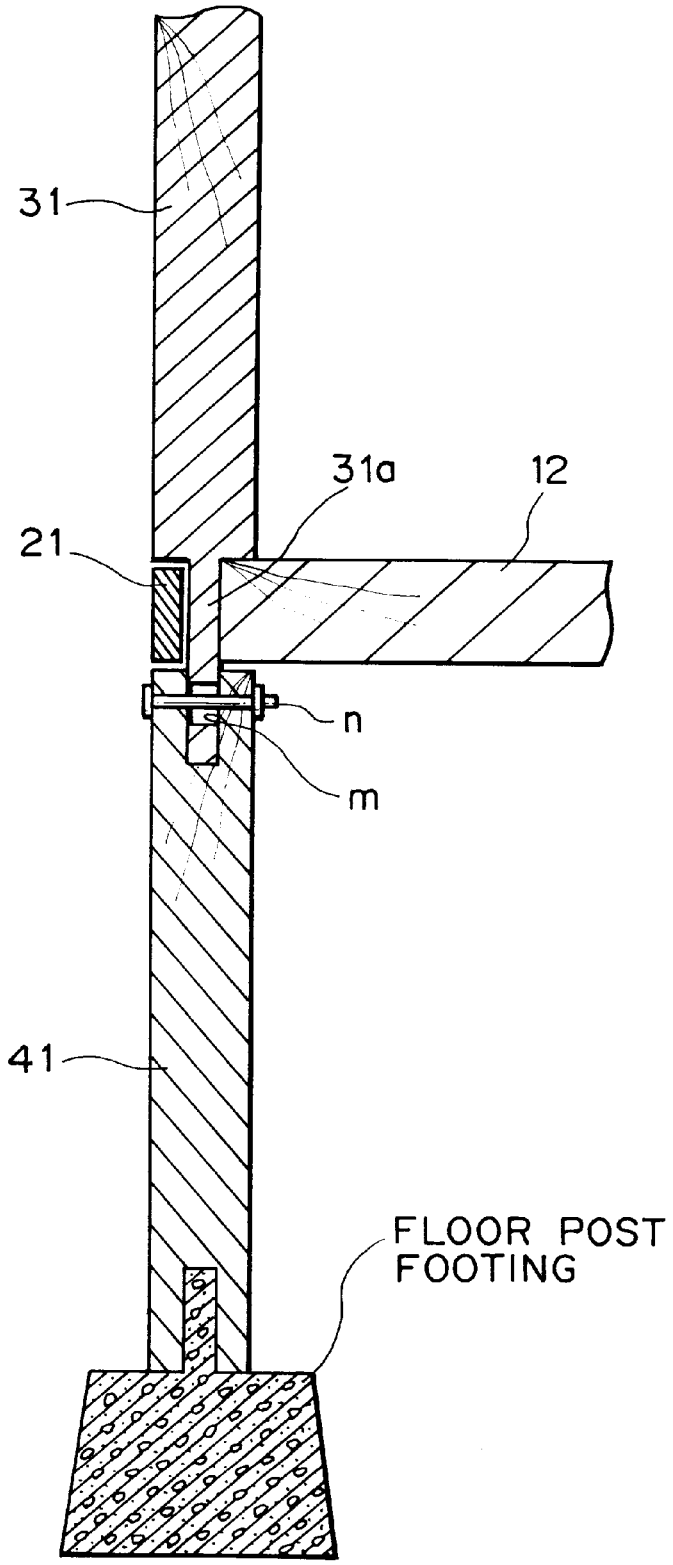
FIG. 11 is a partially cutaway enlarged sectional view of a state wherein an elongated hole is formed in the tenon of the fence post of this embodiment.

An elongated bolt hole m', where the clustered pier 41 and bolt n can vertically slide, is desirably formed in the tenon 31*a* of the fence post 31 which is to be fitted with the tenon recess 41*a* of the clustered pier 41 in the tongue-and-groove joint manner (see FIG. 11).

This is because of the following reason. The height of a floor post footing (to be described later) tends to slightly vary due to the height difference of the ground. If no countermeasure is taken, the height difference is directly reflected in the clustered pier to cause inconveniences, e.g., floating of the clustered pier.

If the elongated bolt hole m' is formed, as shown in FIG. 11, when some difference occurs in the height of the floor post footing due to the height difference of the ground or the like, this height difference can be absorbed by sliding the clustered pier along the elongated bolt hole.

Figure 9:
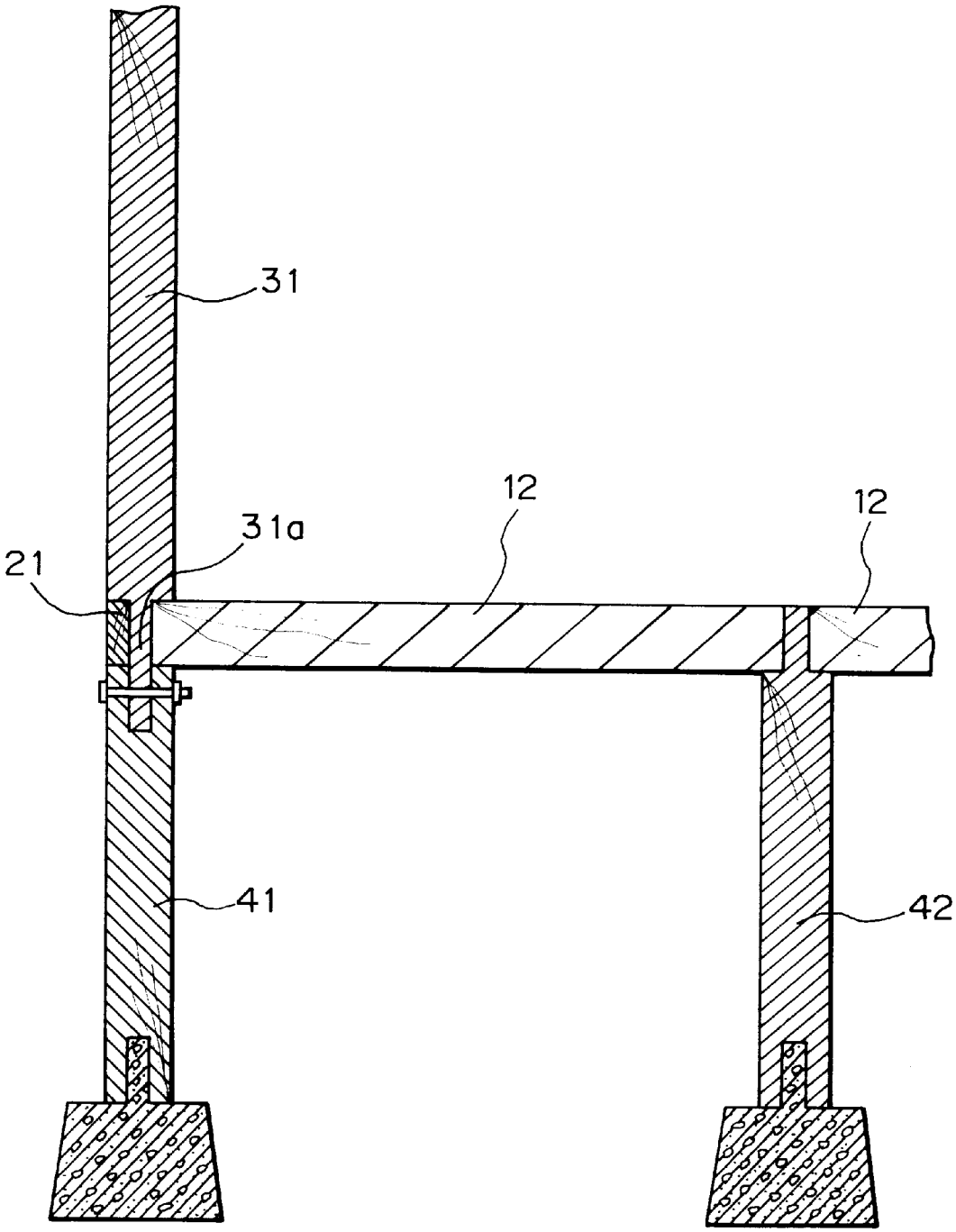
FIG. 9 is a sectional view taken along the line A—A of FIG. 7 when clustered piers 41, clustered piers 42, and fence posts 31 are assembled in FIG. 7.
Figure 10:
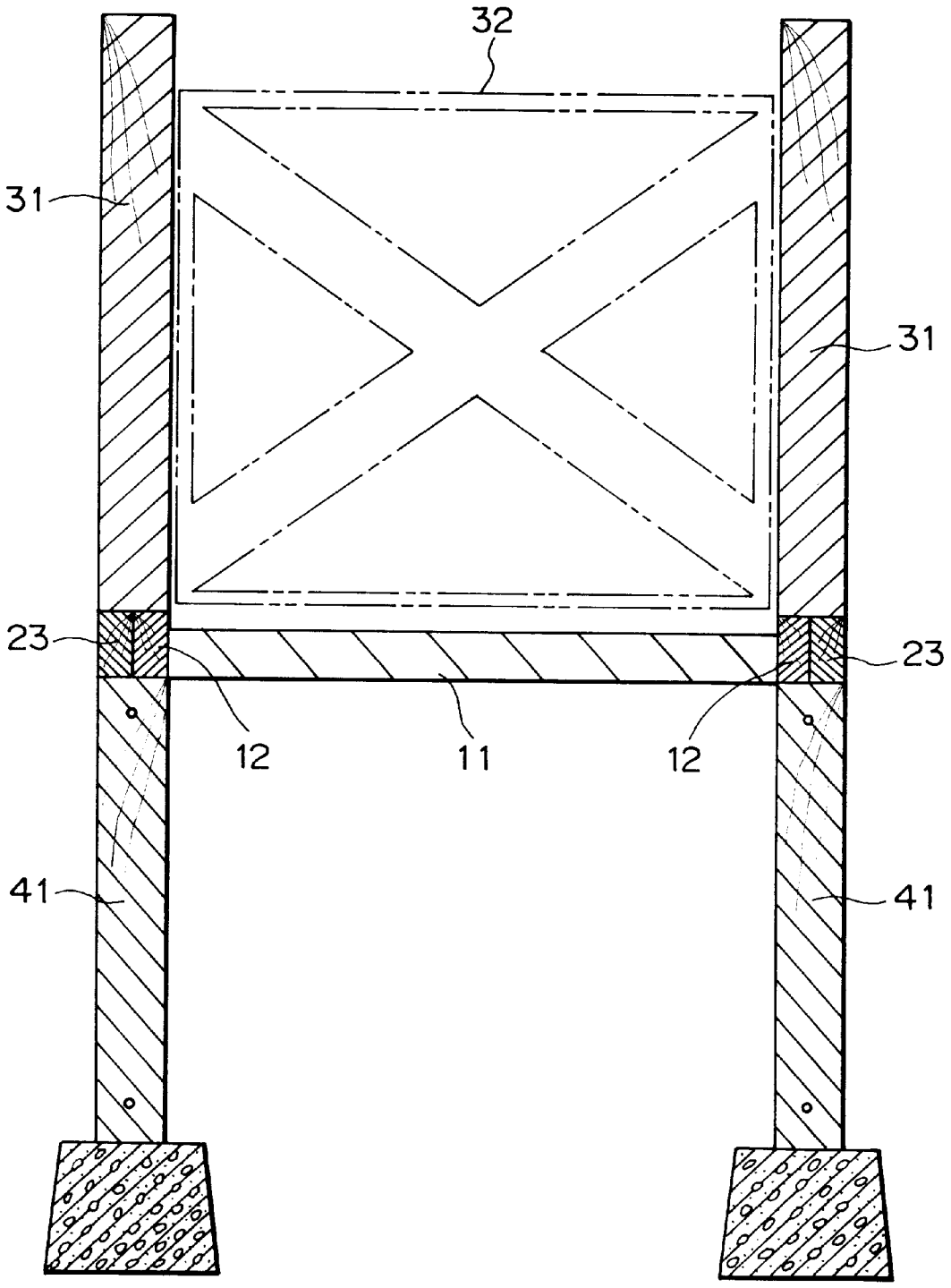
FIG. 10 is a sectional view taken along the line B—B of FIG. 7 when clustered piers 41, fence posts 31, and fence bodies 32 are assembled in FIG. 7.

A floor post footing is disposed under the clustered pier member 40. The floor post footing can be a concrete block or a stone block. The floor post footing is desirably formed with a projection to fit in the tenon recess 41*b* or 42*b* of the clustered pier 41 or 42, as shown in FIGS. 9 to 11. If a projection is formed, the floor post footing can be reliably integrated with the clustered pier 41 or 42 and is prevented from being unexpectedly displaced from the clustered pier 41 or 42.

The types of the respective components that constitute the garden deck of the embodiment described above are merely a small number of types described above. These types of components may be manufactured in advance on the mass production line at a factory or the like. The number of the required components in units of types may be calculated upon reception of the user's order and may be delivered to the construction site.

Therefore, at the construction site, a garden deck having a size matching the user's request can be provided within a short period of time and at a low price by only performing assembly as follows.

The sequence of assembling of the garden deck of this embodiment using the above members, and its function will be described.

To build the garden deck of this embodiment, what kind of deck should be built is studied in accordance with the size, shape, and the like of one's house or cottage and the garden. The number of quadrilateral frame member units and how to connect them are studied. A case wherein two frame members 10 are laterally continuously joined to the main house side and one frame member 10 projects to the garden, as shown in FIGS. 7 and 8, will be described.

The longitudinal deck frames 11 and lateral deck frames 12 are combined longitudinally and laterally to form the quadrilateral frame members 10 (see FIG. 6). The frame members 10 are assembled for a required number. The assembled frame members 10 are continuously joined two on the main house side and one on the garden side.

As a result, the longitudinal deck frames 11 are located adjacent to each other on the main house side, and the lateral deck frames 12 are located adjacent to each other on the garden side (see FIG. 7). Between the adjacent frames, bolts n are inserted in the formed bolt holes m and are fastened with nuts.

Subsequently, the reinforcing deck frames 21 are placed along the longitudinal deck frames 11 in the longitudinal direction on the right and left ends on the main house side, and bolts n are inserted in them and fastened with nuts in the same manner as described above. This reinforces the longitudinal deck frames 11 in terms of physical strength and the like.

Similarly, the reinforcing deck frames 22 are placed along the longitudinal deck frames 11 in the longitudinal direction on the garden side, and bolts n are inserted in them and fastened with nuts in the same manner as described above. Also, the reinforcing deck frame 23 are placed along the lateral deck frames 12 in the lateral direction on the main house side and the garden side, and bolts n are inserted in them and fastened with nuts in the same manner as described above. This forms mortices h at the four corners of each frame member (see FIG. 7).

Subsequently, on the lower side of the deck floor formed by the frame members 10 and reinforcing frame members 20, clustered pier members 40 are set to vertically stand on the floor post footings (see FIGS. 8, 9, and 10). A clustered pier 42 is combined where no fence post 31 will be set later, and a clustered pier 41 is combined where a fence post 31 will be set later.

The clustered pier members 40 may be fixed to the deck floor by lifting the deck floor, placing and fixing the clustered pier members 40 between the lower surface of the deck floor and the floor post footings, and thereafter engaging the lower portions of the clustered pier members 40 and the floor post footing with each other. Alternatively, the deck floor may be turned upside down, the clustered pier members 40 may be fixed to face upward, and thereafter the deck floor fixed with the clustered pier members 40 may be turned upside down and fixed on the floor post footings.

Alternatively, every time one frame member 10 is assembled, clustered pier members 40 that can be disposed on it may be combined with it. Hence, assembly of the clustered pier members 40 is performed along with assembly of the deck floor.

When the clustered pier members 40 and deck floor are formed on the floor post footing, fences are assembled as required.

The fence posts 31 are provided to vertically stand on the upper side of the deck floor, such that their tenons 31*a* extend through the respective mortices h and are fitted in the tenon recesses 41*a* of the clustered piers 41 (see FIGS. 8, 9, and 10).

Then, the tenons 31*a* of the fence posts 31 are fitted in the mortices h formed by the frame members 10 and reinforcing frame members 20 so that the circumferential side walls are supported. Simultaneously, the lower sides of the tenons 31*a* are fixed in the tenon recesses 41*a* of the clustered piers 41 so that the fence posts 31 are reliably fixed and supported through fitting with tenons and from the three-dimensional directions at their lower portions.

If the elongated bolt holes m' where the bolt holes n can vertically slide are formed in the tenons 31*a* of the fence posts 31 that are to be fitted in the tenon recesses 41*a* of the clustered piers 41, when some difference occurs in the height of the floor post footings due to the height difference of the ground or the like, this height difference can be absorbed by sliding the clustered piers 41 and connection bolts n along the elongated bolt holes m'. As a result, floating of the clustered pier that occurs when the clustered pier is short, looseness in the entire structure that occurs when the clustered pier is long, and the like can be prevented (see FIG. 11).

When assembly of the frame members and post members described above is ended, the deck boards of the decking 13 are fitted in the reception grooves 11*a* of the longitudinal deck frames 11 of the frame members 10, and the fence bodies 32 are clamped between the fence posts 31 and fixed by fastening with bolts, thereby completing the garden deck. To perform this fastening with bolts, bolt holes for fixing the fence bodies 32 on the fence posts 31 may be formed at predetermined portions, and bolts and nuts may be mounted at these portions to fix the fence bodies 32.

Alternatively, the fence bodies 32 may be fixed on the fence posts 31 by screwing from the inner side of the side surface of the fence bodies 32.

The fence body 32 may be formed slightly wider than the disposing width of the corresponding fence posts 31, grooves may be formed in the side surfaces of the fence posts 31 on the fence body side to be engageable with the ends of the fence body 32, and the fence body 32 may be fitted in these grooves by, e.g., fitting it from, e.g., above. In this case as well, if the fence body 32 is fixed by fastening with bolts or screwing, it is fixed further firmly.

According to the present invention based on the above arrangement and function, combinations of frame member units and reinforcing frame member units can realize a garden deck that can cope with various types of main houses and gardens. The frame members, reinforcing frame members, clustered piers, fence posts, decking, and fence body enable all assembly. As a result, the assembly operation becomes simple and the manufacturing cost becomes low, providing economical advantages.

Concerning the structure, the tenons of the fence posts are fitted in the mortices formed by the frame members and reinforcing frame members, and are also fixed in the mortice recesses of the clustered piers, so that strong support can be obtained and the fence will not sway. Hence, the present invention is advantageous because it has excellent effects in terms of function as well.

A garden deck having a size matching the user's request can be provided by only changing the number of combinations of predetermined types of components.

Necessary components can accordingly be manufactured in advance on the mass production line. A desired garden deck can be completed by only delivering necessary numbers of necessary types of components to the construction site and assembling these components at the construction site. A garden deck can be assembled at a low cost within a short period of time.

As many apparently widely different embodiments of the present invention can be made without departing from the spirit and scope thereof, it is to be understood that the invention is not limited to the specific embodiments thereof except as defined in the claims.

What is claimed is:

1. A knockdown garden deck wherein a frame member and reinforcing frame members are combined to form a deck floor, said frame member being obtained by combining longitudinal deck frames and lateral deck frames into a quadrilateral shape to place a decking therein, and said reinforcing frame members being framed to form mortices at four corners of said frame member, fence posts formed with elongated tenons to extend through said mortices are provided to vertically stand on an upper side of said deck floor and a fence body is fitted between said fence posts by clamping, and clustered piers formed with tenon recesses at upper ends thereof are provided on a lower side of said deck floor, said tenon recesses serving to fit on said tenons of said fence posts that extend through said mortices.

2. The garden deck according to claim 1, wherein elongated bolt holes where said clustered piers and bolts can slide vertically are formed in said tenons of said fence posts that are to be fitted in said tenon recesses of said clustered piers.

3. A knockdown garden deck wherein longitudinal deck frames and lateral deck frames each having predetermined notches at two ends thereof are combined into a quadrilateral shape to form a frame member having predetermined mortices four corners thereof, said mortices being constituted by said notches at least partially, said mortices constituted by said notches are formed at frame member connecting portions by combining a predetermined number of said frame members, and reinforcing frame members are combined on an outermost side surface of a combined set of said frame members, to form a deck floor where mortices are formed by said reinforcing frame members and the notches of said frame members, fence posts, respectively having elongated tenons projecting to extend through said mortices, are set to stand vertically on an end of an outer frame of the deck floor, and a first clustered pier, having a tenon recess at an upper end thereof, is built, the tenon recess serving to fit with the tenon of said fence post extending through said mortice on a lower side of the deck floor, and a second clustered pier, having at an upper end thereof a tenon that fits with said mortice on the lower side of the deck floor, where said fence post is not set upright, is combined.

4. The garden deck according to claim 3, wherein a fence body having a width substantially equal to a distance between said disposed fence posts is mounted between said fence posts by clamping.

5. The garden deck according to claim 3, wherein bolt holes that communicate with each other when assembled are formed near two ends of each of said longitudinal deck frame, lateral deck frame, and reinforcing frame member, and bolts are inserted in the bolt holes during assembly and are fixed with nuts.

6. The garden deck according to claim 3, wherein grooves each having a predetermined depth are formed in inner side surfaces at upper portions of two opposing frames of said frame member, and a decking is fitted in the grooves, thereby forming the deck floor.

7. The garden deck according to claim 6, wherein said decking is a duckboard-like board.

8. The garden deck according to claim 3, wherein said first and second clustered piers are respectively formed with tenon recesses, at lower ends thereof, to engage with tenons at upper ends of said second clustered pier, when a height from said deck floor to a floor post footing arranged under the deck floor is set to be substantially equal to a height of one clustered pier, said floor post footing is engaged with the tenon recess, and when a height from the deck floor to said floor post footing arranged under the deck floor is set to be substantially not less than a height of one clustered pier, said tenon at an upper end of said second clustered pier is fitted in the tenon recess to connect said second clustered pier.

9. The garden deck according to claim 3, wherein respective components are manufactured in advance and can be assembled by selecting types and numbers of necessary components in accordance with a size of a garden deck to be assembled.

10. The garden deck according to claim 3, wherein an elongated bolt hole where said first clustered pier and a bolt can slide vertically is formed in said tenon of said fence post that is to be fitted in the tenon recess of said first clustered pier.

11. A knockdown garden deck, comprising:

a plurality of frame members forming a polygonal shape;

reinforcing frame members joined to said frame members, said reinforcing frame members having notches, said notches forming mortices; and fence posts extending upward from said reinforcing frame members at said mortices, first clustered piers for supporting said frame members, said clustered piers connected to said fence posts, whereby said clustered piers and fence post can be easily disassembled from said reinforcing frame members.

12. The garden deck according to claim 11, wherein said first clustered piers are connected to said fence posts by mating connectors.

13. The garden deck according to claim 12, wherein said mating connectors are tenons on said fence posts and tenon recesses on said first clustered piers.

14. The garden deck according to claim 11, further comprising second clustered piers connected to said frame members.

15. The garden deck according to claim 11, wherein said mortices are formed by notches in said frame members.

* * * * *